US005398732A

United States Patent [19]

Zenoni et al.

[11] Patent Number: 5,398,732

[45] Date of Patent: Mar. 21, 1995

[54] LAMINA TYPE MODULATED THREAD BRAKING DEVICE FOR WEFT FEEDERS

[75] Inventors: Pietro Zenoni; Giovanni Pedrini, both of Leffe, Italy

[73] Assignee: L.G.L. Electronics S.p.A., Bergamo, Italy

[21] Appl. No.: 223,296

[22] Filed: Apr. 5, 1994

[30] Foreign Application Priority Data

Apr. 8, 1993 [IT] Italy ..... TO93A0242

[51] Int. Cl.[6] ..... D03D 47/34

[52] U.S. Cl. ..... 139/450; 139/194; 242/419.3

[58] Field of Search ..... 139/450, 452, 194; 242/419.3, 419.4, 422, 422.1, 422.3

[56] References Cited

U.S. PATENT DOCUMENTS

| | | | |
|---|---|---|---|
| 4,817,681 | 4/1989 | Krumm et al. | 139/450 |
| 4,875,506 | 10/1989 | Gacsay et al. | 139/450 |
| 4,969,489 | 11/1990 | Tanaka et al. | 139/450 |
| 5,244,164 | 9/1993 | Gacsay | 139/450 X |
| 5,329,962 | 7/1994 | Ohnishi et al. | 139/450 |

FOREIGN PATENT DOCUMENTS

| | | | |
|---|---|---|---|
| 0357975 | 3/1990 | European Pat. Off. . | |
| 0536088 | 4/1993 | European Pat. Off. . | |
| 2568595 | 2/1986 | France . | |
| 3614091 | 11/1987 | Germany | 139/194 |

*Primary Examiner*—Andrew M. Falik

*Attorney, Agent, or Firm*—Guido Modiano; Albert Josif; Daniel O'Byrne

[57] ABSTRACT

A modulated thread beating device for weft feeders has a first lamina and a second lamina that are arranged opposite one another and are supported by pairs of fixed and respectively movable bars that engage the ends of the respective laminae, flexing them in an arched shape; the laminae are arranged opposite each other at their convex face. The movable bars are supported by a corresponding movable element which is suspended elastically and is provided with an energization coil that is subjected to the field of a permanent magnet. The coil of the movable element is supplied with an energization current that is modulated in proportion to the advancement speed or mechanical tension of the thread.

11 Claims, 4 Drawing Sheets

LAMINA TYPE MODULATED THREAD BRAKING DEVICE FOR WEFT FEEDERS

BACKGROUND OF THE INVENTION

The present invention relates to a device for the modulated braking of the thread for devices that feed weft to looms or textile machines.

As is known, weft feeders are devices that are suitable to accumulate a reserve of thread in the form of turns wound around a fixed drum and to feed the loom by unwinding the accumulated turns by an amount equal to the length of thread required by the loom at each beating; this length is equal to the transverse dimension, or height, of the fabric being formed. During its motion for unwinding from the drum, the thread is subjected to the action of a braking means which is also associated with the weft feeder; the braking means has the purpose of keeping said thread at a preset mechanical tension that is suitable to ensure its correct unwinding.

During the beating, the thread advancement speed varies in an approximately sinusoidal manner, and the action of the braking means, which depends on the friction coefficient between the thread and the braking means, varies accordingly. Consequently, the tension of the thread is subject to considerable and undesirable increases that cause frequent breakage.

In order to avoid this severe drawback, it has already been proposed to positively modulate the action of the braking means, adapting it to the instantaneous values of the advancement speed or to the mechanical tension of the thread.

Electromagnetically operated modulated-braking devices have already been produced for this purpose; in these devices, the braking means is rigidly coupled to a moving element that supports an energization coil immersed in the field of a permanent magnet. The energization coil is supplied with a current that varies in proportion to the thread advancement rate or to its mechanical tension, and this energization current, by interacting with the field of the permanent magnet, modulates the action of the braking means in order to keep the tension of said thread substantially constant.

A typical modulated-action braking means of conventional devices is constituted by a rigid body which is pressed with variable force against the drum, or against a portion of the drum, of the feeder; the thread runs between said body and said drum or drum portion.

This known solution has some drawbacks. In fact, on one hand it considerably complicates the structure of the feeder, because it is necessary to have an adjustable and flexible support for the braking body, and on the other hand the rigid body that forms the braking means produces undesirable twisting of the thread. Furthermore, if said rigid braking body has a circumference that is equal, or substantially equal, to the circumference of the drum of the feeder, its presence makes it troublesome to use additional braking elements of the known brush type; however, this use is advantageous to avoid—as it is well-known to the expert in the field—the formation of the so-called "balloon".

On the other hand, if the circumference of the rigid braking body is smaller, or much smaller, than the circumference of the drum, in order to facilitate the installation of said additional brush-like braking element, the effectiveness of said small-circumference rigid body is very low in terms of modulating the braking action.

Another known solution that tends to avoid the use of said braking body uses a winder that is located downstream of the drum of the feeder and comprises a series of equidistant fixed rods and a series of equidistant movable rods that are interleaved with the fixed rods and are supported by a movable element that has an energization coil subjected to the field of a permanent magnet. The thread runs between the fixed and movable rods and winds partially around them, forming winding angles that vary according to the movements of the movable rods with respect to the fixed rods produced by corresponding movements of said movable element.

The mechanical tension $T_u$ of the thread at the output of the device is in direct proportion to said winding angles according to the relation $$T_u = T_i \times e^{n-lf\alpha}$$

where $T_i$ is the input tension, f is the friction coefficient between the thread and the rods, $\alpha$ is the winding angle and n is the total number of rods.

The drawback of this further known type of braking means that uses a winder resides in that it essentially operates like a modulating amplifier for the input tension $T_i$, so that it is necessary to provide an additional braking means that produces said input tension, possibly in a controlled manner; in terms of the modulation produced by the winder-based braking means, it is preferable for the input tension to be as independent as possible of the acceleration imparted to the thread.

SUMMARY OF THE INVENTION

The aim of the present invention is to obviate these drawbacks, and within the scope of this general aim, the present invention has the important and particular object of providing a device for the modulated braking of thread which is structurally simple, can be applied to any kind of existing feeder equipped or not with additional braking means, but is fully independent of the presence and value of an input tension $T_i$.

A particular and important object of the present invention is to provide a device for the modulated braking of the thread in which the variation of the braking action is comprised within very wide limits in order to give the device an extensive ability to modulate the braking action.

In order to achieve this aim, this object and others which will become apparent from the following detailed description, the present invention relates to a modulated thread braking device for weft feeders, characterized in that it comprises a first lamina and a second lamina that are arranged opposite one another and are supported by pairs of fixed and respectively movable bars that engage the ends of the respective laminae, flexing them in an arched shape in order to define a respective convex face, said laminae being arranged opposite each other at their convex face; in that said movable bars are supported by a corresponding movable element which is suspended elastically and is provided with an energization coil that is subjected to the field of a permanent magnet; and in that said device further comprises means for supplying the coil of the movable element is supplied with an energization current that is modulated in proportion to the advancement speed or mechanical tension of the thread.

According to the invention, the ends of each lamina are detachably engaged in radial seats of the respective pairs of supporting bars, and the length of the laminae is chosen so that it is greater than the center distance of said respective pair of bars by an amount that corresponds to the deformation of the lamina and therefore to the selected rigidity.

The current for the energization of the coil of the movable element is modulated starting from an initial predefined value Io which can be preset according to the requirements of use; this value corresponds to the maximum braking action, hereinafter termed briefly static braking, applied by the device to the motionless thread.

BRIEF DESCRIPTION OF THE DRAWINGS

Further characteristics and advantages will become apparent from the following detailed description and with reference to the accompanying drawings, which are given by way of non-limitative example and wherein.

DESCRIPTION OF THE PREFERRED EMBODIMENTS

Figure 1:
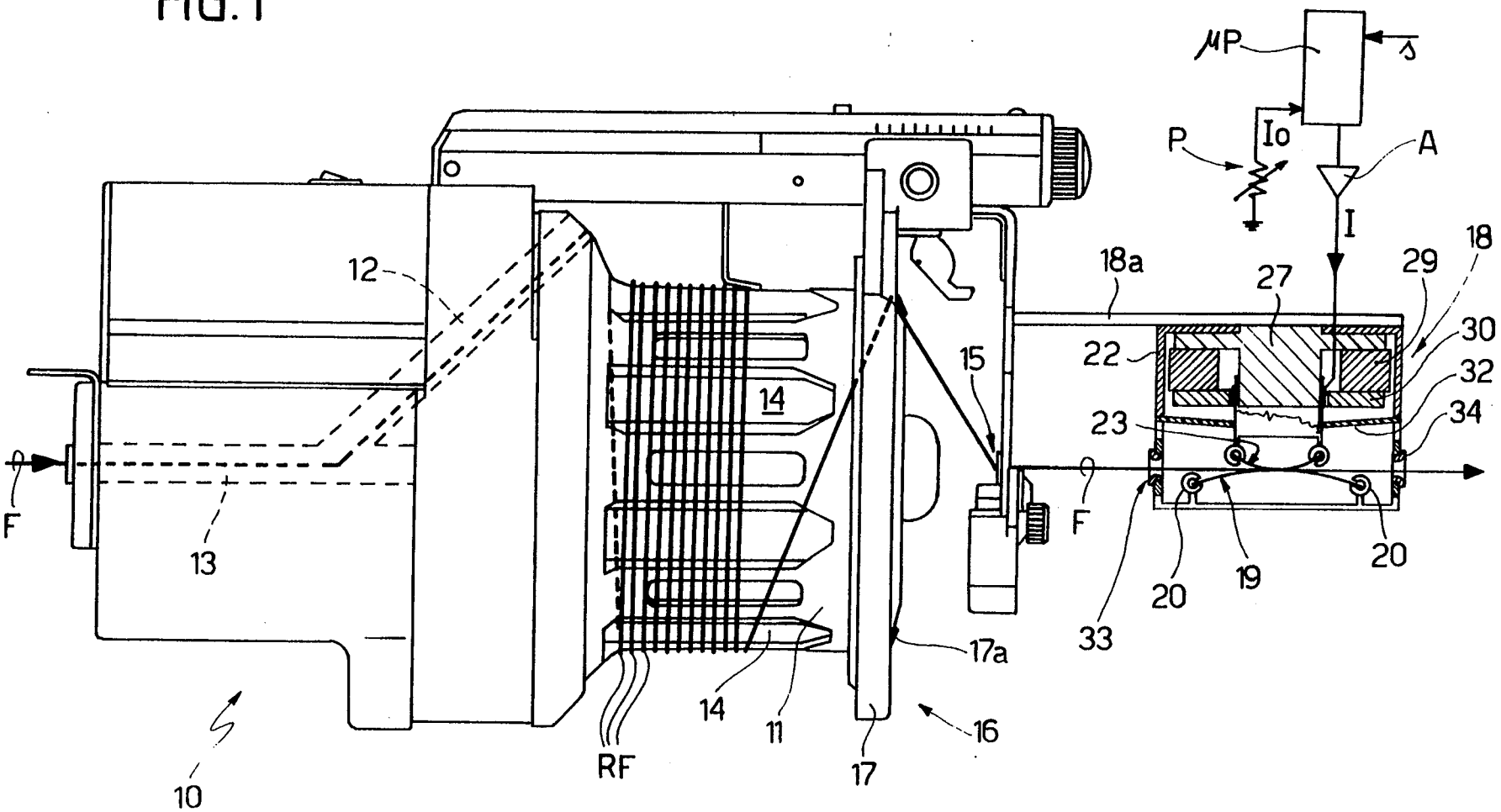
FIG. 1 is a longitudinal sectional elevation view of a weft feeder with the modulated braking device according to the present invention.
Figure 2:
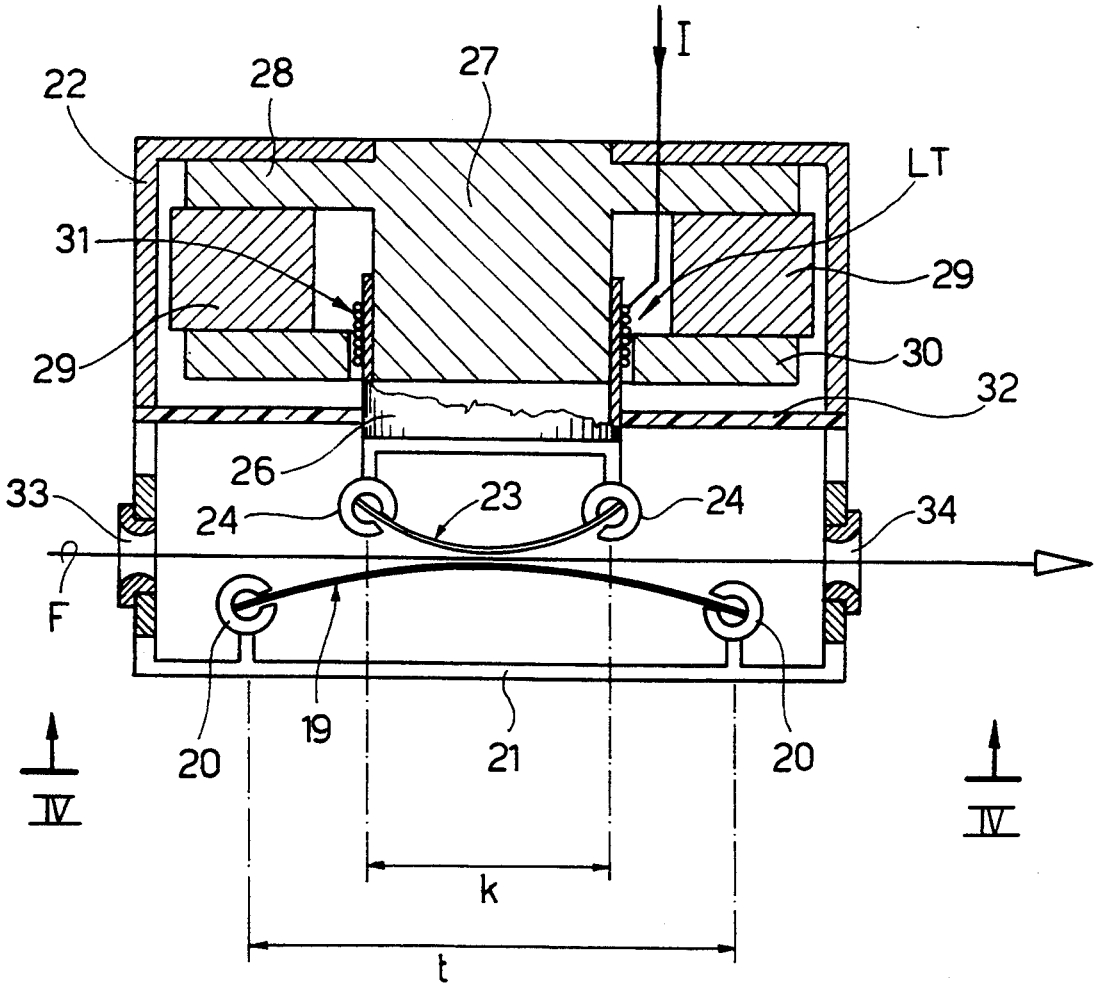
FIG. 2 is an enlarged-scale longitudinal sectional view of the device of FIG. 1.

In FIG. 1, the reference numeral 10 designates a weft feeder of the conventional type that comprises a fixed drum 11 on which a hollow arm 12, rigidly coupled to an equally hollow drive shaft 13, winds a plurality of turns of thread that form a thread reserve RF.

The thread F unwinds from a spool, not shown, and passes in the cavity of the shaft 13 and of the arm 12 to accumulate on the drum 11, where a series of rods 14 that have an undulating motion makes the turns advance toward the head of said drum.

The thread unwinds from the drum 11 to feed the loom or other textile machine, passing in a thread guide 15 which is arranged coaxially to the drum 11. In its unwinding motion, the thread is first of all braked by a possible first braking means 16 of the conventional type with brushes, constituted by a ring 17 which surrounds the drum 11 and is provided with an internal annular set of bristles **17*a* that extends radially so as to engage the drum by contact. The purpose of the braking means 16** is mainly to avoid the forming of the so-called "balloon" and its presence is advantageous but not indispensable.

The modulated braking device 18 according to the present invention is located after the thread guide 15 and is supported by a bracket **18*a*. The device 18 essentially comprises a first metal lamina 19 which is supported, at its ends, by a pair of fixed bars 20 which are mutually spaced by an extent "t". The length of the laminae 19 is greater than the extent "t" by which the bars 20** are mutually spaced, so that the lamina, when inserted between said bars, flexes into an arched shape; the convex part of the arc is directed upward (with reference to the drawing), as shown in the figure.

The fixed bars 20 are supported by a rigid bracket 21 that lies above a cylindrical cup-shaped container 22. Above the first lamina 19 there is a second metal lamina 23, the ends of which are supported by a corresponding pair of movable bars 24 which are mutually spaced by an extent "k" which is less than the extent "t" by which the fixed bars 20 are spaced, so that the second lamina 23 is significantly shorter than the first one, for example 40% shorter.

The length of the lamina 23 is also greater than the space "k" between the bars 24, so that said lamina fits between the bars by flexing into an arched shape; the convex portion of this arc is directed downward (with reference to the drawing), so that the two laminae 19–23 face one another at their respective convex portions. The difference between the length of each lamina and the corresponding spacing "t" and "k" of the respective pair of supporting bars sets the curvature of the laminae and thus the elastic rigidity of the system.

Figure 3:
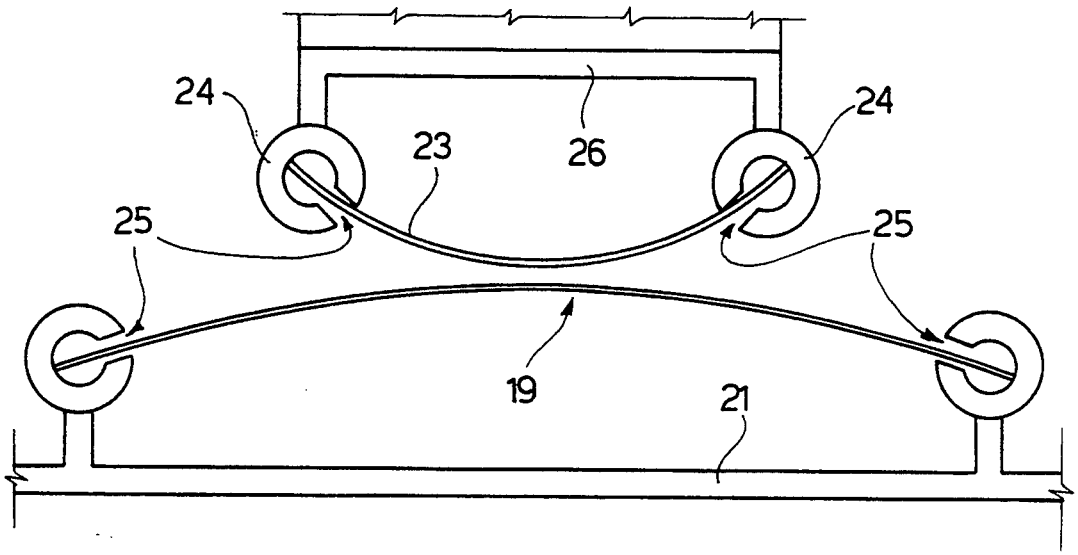
FIG. 3 is an enlarged-scale view of a detail of FIG. 2.
Figure 4:
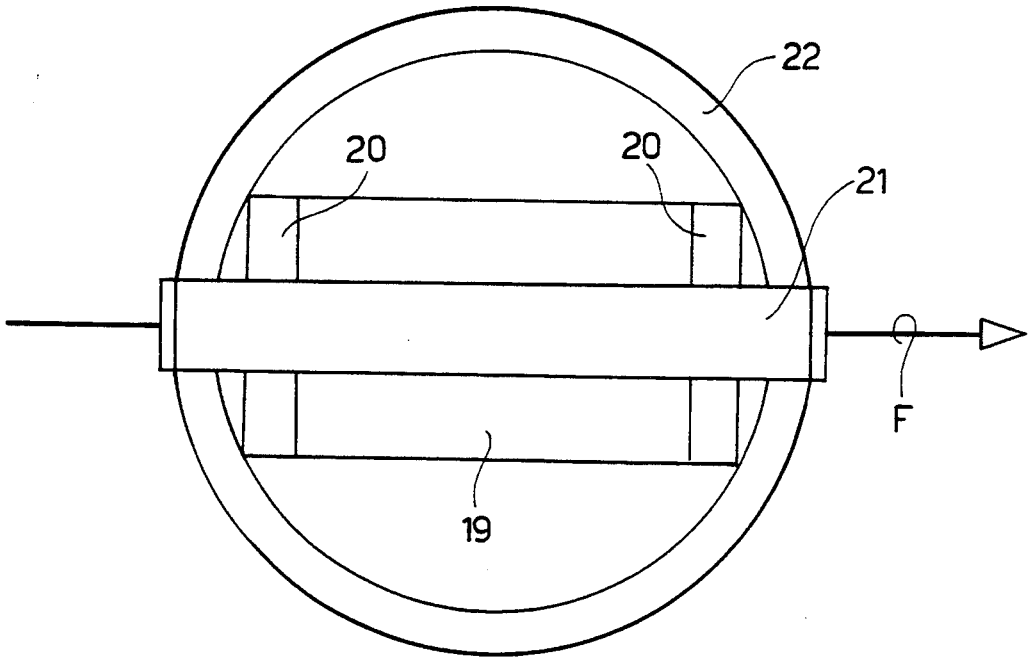
FIG. 4 is a bottom plan view of FIG. 2.

As clearly shown in the detail view of FIG. 3, the individual bars of each pair have seats formed by radial slits 25 that detachably receive the corresponding ends of the respective laminae so that they can be easily removed and replaced with other ones having a different length and/or elastic characteristic in order to vary said elastic rigidity of the system.

The movable bars 24 and the lamina 23 are rigidly coupled to a movable element 26 which is constituted by a cylindrical case of a material that has a low relative density, for example cardboard or synthetic-fiber fabric, impregnated with polymeric resin. The movable element 26 is fitted, so that it can slide freely, on the cylindrical hub 27 of a permanent magnet 28 which is arranged in the cup-shaped container 22 and with which a toroidal core 29 and an annular disk 30 are associated; said disk 30 delimits, together with the hub 27, an annular gap LT in which the case that constitutes the movable element 26 passes. Said movable element has, at said gap LT, a coil 31 which is supplied with an energization current I that varies in inverse proportion to the variation of the mechanical tension of the thread, so that an increase in said mechanical tension is matched by a decrease in the energization current.

As shown in the figure, the case of the movable element is supported by an elastic membrane 32 that can be made of rubber or impregnated cardboard and the like or of thin steel plate.

The direction of the energization current I is chosen so as to move the movable element 26, in contrast with the elastic action of the membrane 32, in the direction for the mutual approach of the laminae 19–23. The thread F runs between said laminae and is guided by thread guiding rings 33–34 which are aligned of the plane of tangency of the laminae. An amplifier A supplies the energization current I, which as mentioned earlier is variable, to the coil 31 of the movable element 26. The amplifier A is driven by a microprocessor $\mu p$ that receives in input a signal "s" which is supplied by the loom and is proportional to the change in the speed of an element of said loom, for example the grippers, or by a transducer which is sensitive to the mechanical tension of the thread (strain-gauge), so that said signal is proportional to said mechanical tension.

At least one potentiometer P, associated with the microprocessor $\mu p$, sets an initial value Io for the energization current which is chosen according to the requirements of use (for example according to the count of the thread F being processed) and corresponds to the maximum braking action applied by the laminae 19–23 to the motionless thread (static braking). Starting from the maximum value $I_{Max}$, the energization current I is modulated downward, so as to reduce the braking action applied by the laminae to the thread as the advancement speed increases and as the mechanical tension of said thread consequently increases.

In the absence of the current Io, i.e. when the device is idle, the laminae 19–23 are mutually spaced, for example by an extent equal to 5–10 tenths of a millimeter, so that contact pressure is zero.

Figure 5:
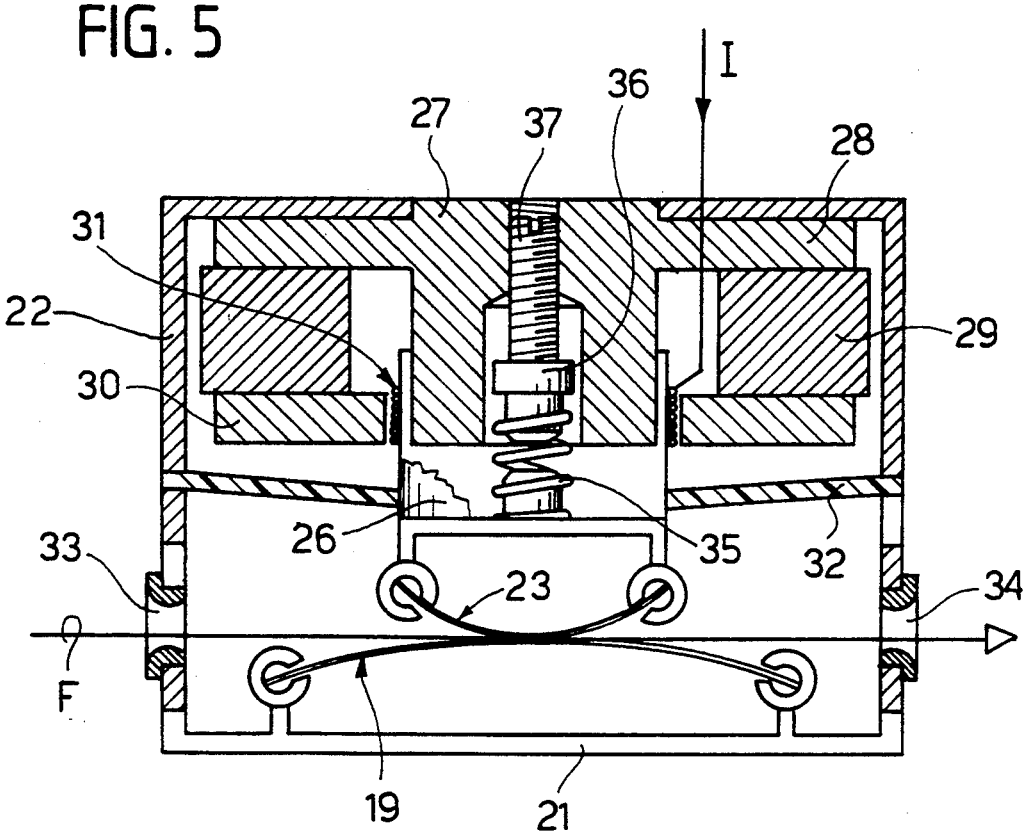
FIGS. 5 and 6 are sectional views, similar to FIG. 2, illustrating respective embodiments of the invention.

In the embodiment of FIG. 5, in which similar or corresponding parts have been designated by the same reference numeral, the lamina 23 is subjected to the elastic action of a spring 35 that acts on the movable element 26 and contrasts against a pin 36. The spring 35 provides a static elastic pressure between the laminae 19-23 even in the absence of the current Io which can be advantageous in some operating conditions and for higher-count threads. An adjustment screw 37, rigidly coupled to the pin 36, allows to vary the position of said pin and accordingly vary the value of said static elastic pressure applied by the spring 35.

Figure 6:
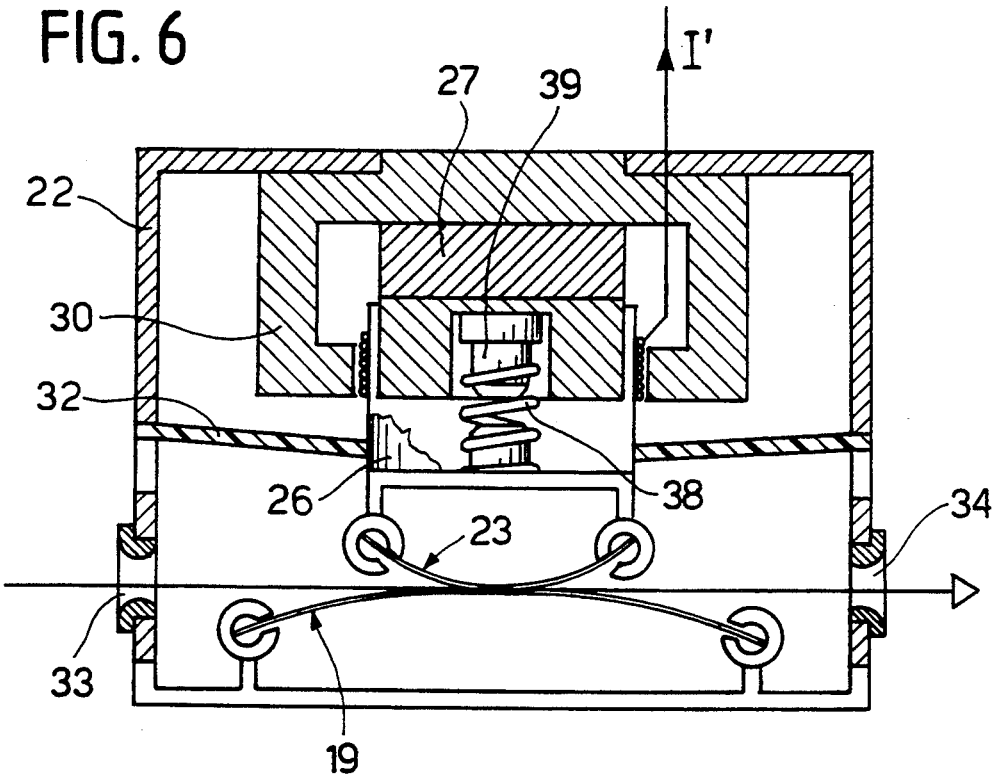

In the embodiment of FIG. 6, a spring 38, which reacts on a pin 39 whose position can be adjustable, acts on the movable element 26 to instead provide the maximum static braking pressure in replacement of the pressure applied by the initial current Io, which is eliminated. In this case, the modulated current I' is orientated so as to produce the mutual spacing of the laminae 19–23 starting from the maximum braking value applied by the spring 38.

The details of execution and the embodiments may naturally be altered extensively, without varying the concept of the invention, with respect to what has been described and illustrated by way of non-limitative example, without thereby abandoning the scope of the invention.

What is claimed is:

1. Modulated thread braking device for weft feeders, comprising a first lamina and a second lamina that are arranged opposite one another and are supported by pairs of fixed and respectively movable bars that engage the ends of the respective laminae, flexing them in an arched shape in order to define a respective convex face, said laminae being arranged opposite each other at their convex face;

said movable bars being supported by a corresponding movable element which is suspended elastically and is provided with an energization coil that is subjected to the field of a permanent magnet; and said device further comprising means for supplying said coil of the movable element with an energization current that is modulated in proportion to the advancement speed or mechanical tension of said thread.

2. Device according to claim 1, wherein the bars of each pair are spaced by a respective extent and in that the length of the corresponding lamina is greater than the spacing of the bars by an amount which corresponds to the curvature selected for the laminae.

3. Device according to claim 1, wherein the individual bars that support the laminae have seats that are defined by radial slits that detachably receive the ends of the respective laminae.

4. Device according to claim 1, wherein it comprises a membrane of flexible material, said movable element being constituted by a case made of a material that has a low relative density and is adapted so that it can slide freely on the hub of said permanent magnet and is suspended elastically by means of said membrane of flexible material.

5. Device according to claim 4, wherein said permanent magnet comprises and annular gap, said movable element being adapted to slide within said annular gap, said permanent magnet having said energization coil arranged at said gap.

6. Device according to claim 1, wherein it comprises means for modulating the current supplied to the energization coil of the movable element, said current being modulated in proportion to the advancement speed or mechanical tension of the thread.

7. Device according to claim 6, wherein the energization current has a direction which is adapted to move the movable element, in contrast with the elastic action of the suspension membrane, in the direction along which said opposite laminae approach one another.

8. Device according to claim 6, wherein said modulated current is provided by an amplifier driven by a microprocessor that for receiving as an input a modulation signal which is proportional to the speed of an element of the loom or to the mechanical tension of the thread.

9. Device according to claim 8, further comprising at least one potentiometer which is associated with said microprocessor and is adapted to set a maximum initial value for the energization current which corresponds to the maximum braking action applied to the thread by said opposite laminae.

10. Device according to claim 6, wherein it comprises a springs the lamina supported by the movable element is suspended elastically by means of said spring that pushes said lamina against the opposite fixed lamina with a force that corresponds to the maximum braking action applied by said lamina to the thread, and that said means for modulating said current orientate the modulated energization current supplied to the coil of the movable element so as to separate said laminae in contrast with the action of said spring.

11. Device according to claim 1, wherein it comprises a spring, the lamina supported by the movable element is subjected to the adjustable action of said spring that suspends elastically the movable element and is adapted to produce a static elastic pressure between the fixed lamina and the movable lamina in the absence of an energization current supplied in the coil of said movable element.

* * * * *